United States Patent [19]

Sotome et al.

[11] Patent Number: 4,915,042

[45] Date of Patent: Apr. 10, 1990

[54] DEVICE FOR CORRECTING BENDING OF TOWEL CLOTH

[75] Inventors: Kenichi Sotome, Tochigi; Munetaka Nagasaki, Osaka, both of Japan

[73] Assignee: SSMC Inc., Fairfield, N.J.

[21] Appl. No.: 338,702

[22] Filed: Apr. 17, 1989

[30] Foreign Application Priority Data

Jun. 7, 1988 [JP] Japan ..... 63-74795

[51] Int. Cl.[4] ..... D05B 21/00; D05B 37/04

[52] U.S. Cl. ..... 112/121.26; 112/121.27; 112/113; 112/130; 112/305

[58] Field of Search ..... 112/121.26, 121.27, 112/130, 305, 306, 307, 113

[56] References Cited

U.S. PATENT DOCUMENTS

| | | | |
|---|---|---|---|
| 2,685,664 | 8/1954 | Visconti | 112/130 X |
| 3,381,639 | 5/1968 | Miller | 112/130 |
| 4,548,146 | 10/1985 | Okada | 112/305 X |
| 4,561,365 | 12/1985 | Schmidt et al. | 112/121.27 |
| 4,589,361 | 5/1986 | Starnes et al. | 112/305 X |
| 4,590,876 | 5/1986 | Mencke et al. | 112/306 X |
| 4,644,882 | 2/1987 | Fenzel | 112/305 X |
| 4,706,585 | 11/1987 | Schuurmans | 112/121.27 |
| 4,742,790 | 5/1988 | Wilber | 112/121.26 X |
| 4,803,935 | 2/1989 | Off | 112/121.27 |

*Primary Examiner*—H. Hampton Hunter

*Attorney, Agent, or Firm*—Theodore C. Jay

[57] ABSTRACT

A pair of first and second working tables are oppositely disposed and spaced apart. A detector at the first working table is used to distinguish a thickness of a plain fabric portion from that of a pile fabric portion of a towel cloth. A cutting unit at the first working table is spaced from the detector by a predetermined interval for cutting the towel cloth. A base plate at the second working table on which a clamping unit is mounted for clamping and drawing the towel cloth. A towel cloth drawing unit employing a bar member extends over the space between the first and the second working tables across the upper surface of the towel cloth and is movable vertically for drawing the towel cloth from a towel material. A pneumatic cylinder is disposed on the upper portion of the body. A plurality of correction pieces disposed on the body and urged by the forward actuation of the pneumatic cylinder contact and press the upper surface of the towel cloth thereby correcting bending of the towel cloth.

8 Claims, 4 Drawing Sheets

DEVICE FOR CORRECTING BENDING OF TOWEL CLOTH

BACKGROUND OF THE INVENTION

1. Field of the Invention

The present invention relates to a device for correcting misalignment of a towel cloth which may occur at the time of preparing the towel cloth by drawing a towel material having a pile fabric portion and the plain fabric portion which are continuous one after the other, and cutting the plain fabric portion.

2. Prior Art

A prior art cutting device for preparing a piece of towel cloth by cutting a towel material of long size employs an identification means for identifying the pile fabric portion from the plain fabric portion by thickness, sizes, differences of the light transmittance, or by an optical sensor and a drive means composed of a pair of rollers combined with the identification means.

Another prior art cutting device is disclosed in the Japanese Patent Laid-Open Publication No. 60-75667. The cutting device is provided with a device for correcting misalignment of the towel cloth which includes a pair of feeding rollers. More particularly, the prior art device for correcting misalignment of the towel employs a receiver for identifying a thickness and a size of a pile fabric portion from those of a plain fabric portion, a rotary wheel provided with a plurality of feeding rollers for feeding the towel cloth, and a rotary wheel provided with a plurality of presser rollers wherein each feeding roller slips when the pile fabric portion of the towel cloth comes to the receiver.

Inasmuch as the end portion of the pile fabric portion is irregularly fed by the rollers upon drawing the towel cloth, the widths of the towel cloths may vary. The towel cloth having greater width requires a plurality of feeding rollers each having a complex structure which entails a complex device for correcting the towel cloth. Furthermore, it is difficult to cut the small sized towel cloths because the diameter of the feeding roller provided with the slip means is large.

SUMMARY OF THE INVENTION

It is an object of the present invention to provide a device for correcting misalignment of a towel cloth which is adapted to cut various sized towel cloths using a compact and a simple structure.

To achieve the object of the present invention, a device for correcting misalignment of the towel cloth, when a piece of towel cloth is drawn from a towel material and cut off, utilizes a pair of first and second working tables integrated with an automatic sewing machine which are oppositely disposed and spaced apart. A thickness detector is provided at an end of the first working table for distinguishing a thickness of a plain fabric portion from that of a pile fabric portion of a towel cloth delivered to the first working table. A cutting unit is disposed across the first working table and spaced from the detector in a predetermined interval for cutting the towel cloth. A towel cloth drawing unit composed of a bar shaped body is positioned over the space between the first and the second working tables across the upper portion of the towel cloth width and is movable vertically for drawing the towel cloth from the towel material. A plurality of correcting pieces disposed at the bar shaped body are urged by pneumatic cylinders disposed at the body for pressing and bending the upper surface of the towel cloth. A clamping unit is mounted on a base plate on the second working table and is movable toward the second working table for clamping and drawing the towel cloth.

The above and other objects, features and advantages of the present invention will become more apparent from the following description taken in conjuction with the accompanying drawing.

BRIEF DESCRIPTION OF THE DRAWINGS

FIG. 2 (*b*) is a side view of the towel cloth of FIG. 2 (*a*).

PREFERRED EMBODIMENT OF THE INVENTION

Figure 2:
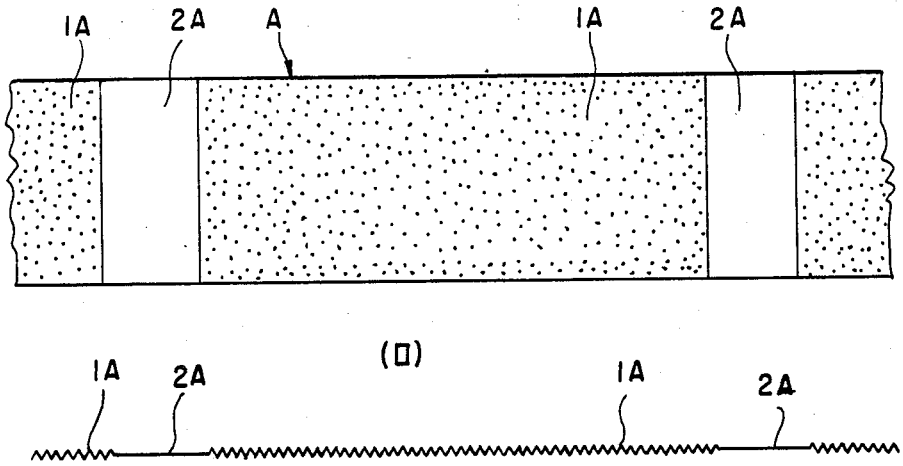
FIG. 2 (*a*) is a plan view showing towel material having plain and pile fabric portions continuous one after the other which is used in the device for correcting misalignment of towel cloth of FIG. 1.

A towel cloth A used in the present invention comprises a single pile fabric portion 1A and a single plain fabric portion 2A. The towel cloth A is prepared by drawing a towel material of long size as illustrated in FIG. 2 in which the pile fabric portion 1A and the plain fabric portion 2A are continuous one after the other, and cutting the plain fabric portion 2A.

Figure 1:
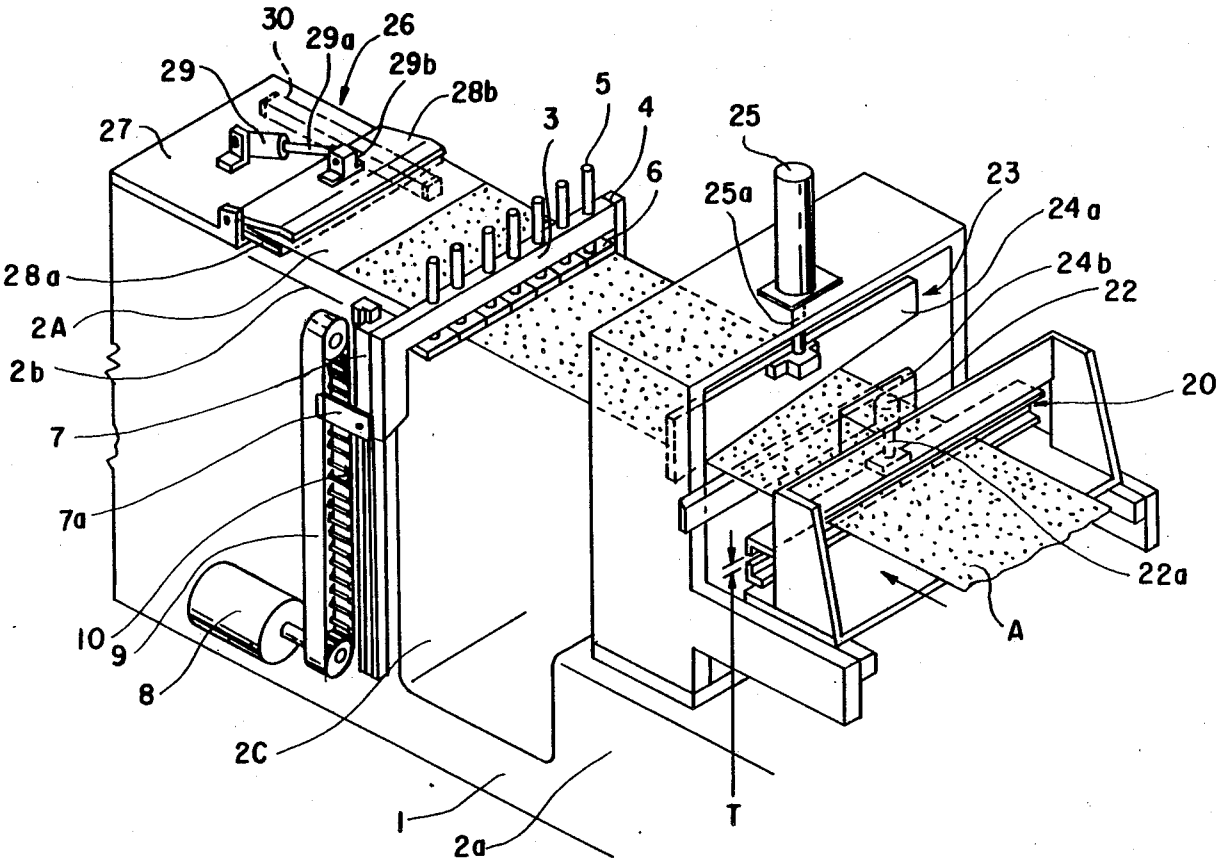
FIG. 1 is a perspective view showing a device for correcting misalignment of towel cloth according to a preferred embodiment of the invention.
Figure 3:
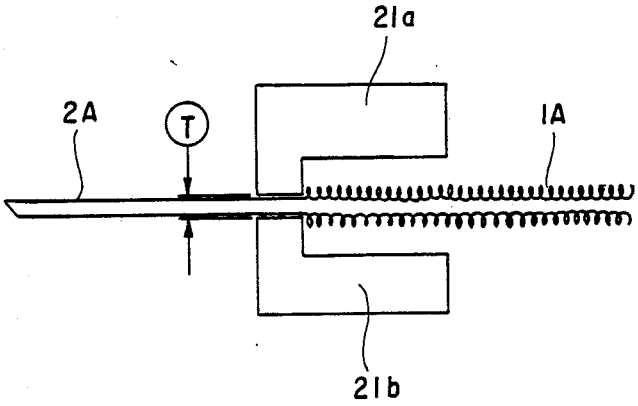
FIG. 3 shows a thickness detector employed in the device for correcting misalignment of towel cloth of FIG. 1.
Figure 4A:
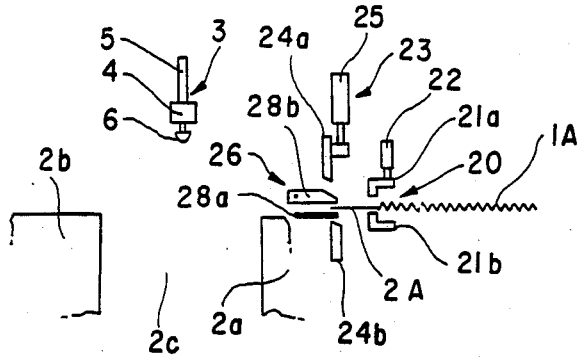
FIGS. 4 (*a*), (*b*), (*c*), (*d*), (*e*), and (*f*) illustrate difficult steps in the operation of the device of FIG. 1.
Figure 4B:
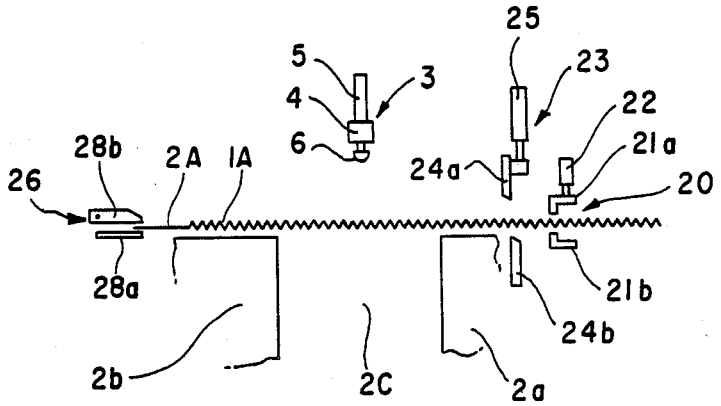
Figure 4C:
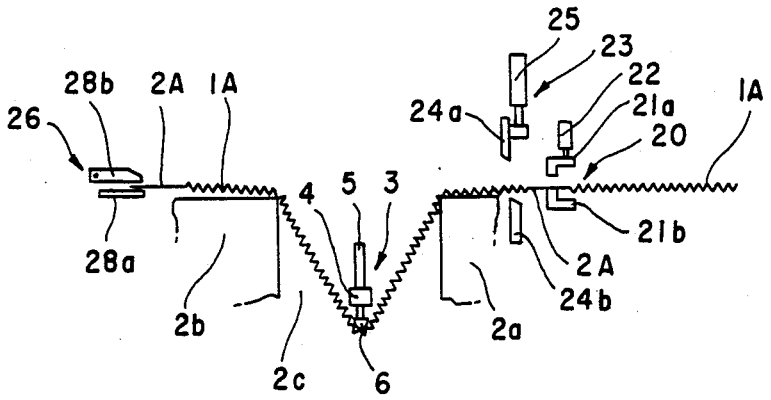
Figure 4D:
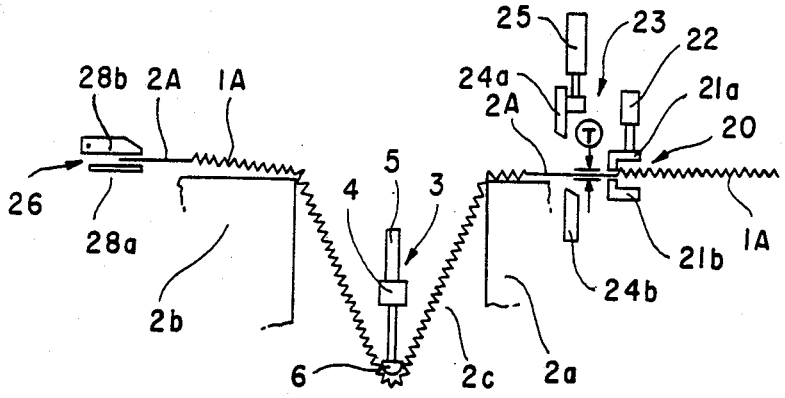
Figure 4E:
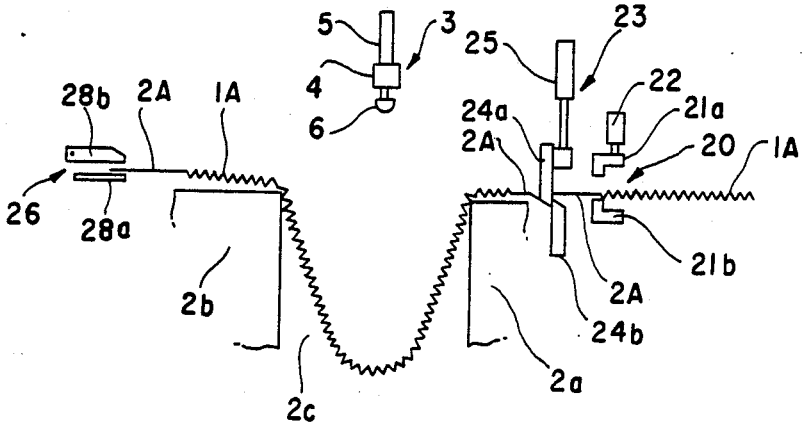
Figure 4F:
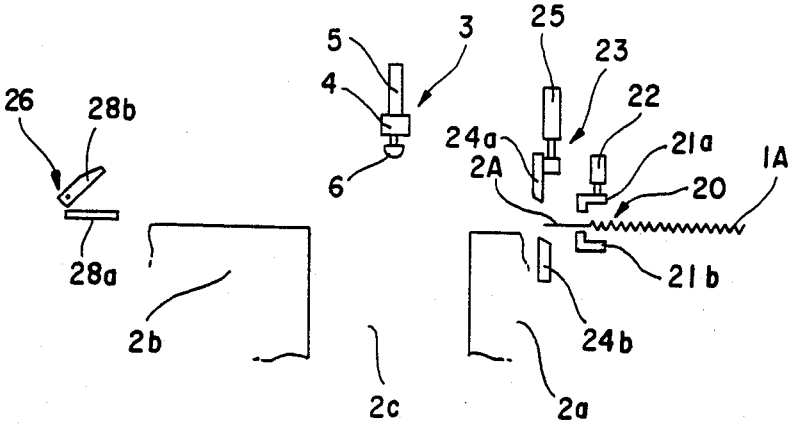

A preferred embodiment of the present invention will be described with reference to FIGS. 1 to 3.

The device for drawing towel cloth comprises a pair of first and second working tables 2*a*, 2*b* integrated with a body of an automatic sewing machine 1. These tables are oppositely disposed and separated by space 2*c*. A detector 20 is positioned at an end of the first working table 2*a* for distinguishing a thickness of the plain fabric portion 2A from that of the pile fabric portion 1A of a towel cloth A delivered to the first working table 2*a*. A cutting unit 23 extends across the first working table 2*a* and is spaced from the thickness detector 20 in a predetermined amount for cutting the towel cloth A. A towel cloth drawing unit 3 extends over the space 2*c* across the towel cloth in the longitudinal direction thereof and movable vertically for drawing the towel cloth A from the towel material. A clamping unit 26 is mounted on a base plate 27 which is provided on the second working table 2*b* and movable toward the first working table 2*a* for clamping and drawing the towel cloth A.

The detector 20 is composed of an upper block 21*a* and a lower block 21*b* respectively extending across the first working table 2*a* and a pneumatic cylinder 22 for positioning the upper and the lower blocks 21*a*, 21. The upper block 21*a* is fixed to a tip end of a piston rod 22*a* of the pneumatic cylinder 22 which is secured to the body of the automatic sewing machine 1 in know manner, typically via a supporter (not shown) while the lower block 21*b* is secured to the body of the automatic sewing machine 1 in known manner, typically via a supporter (not shown). The upper and the lower blocks 21*a* and 21*b* are separated by a slit T which is varied by lowering the upper block 21*a* by the forward actuation of the pneumatic cylinder 22 to define a stoppage gap T which permits that plain fabric portion 2A to pass therefrom but blocks passage of the pile portion of the pile portion 1A.

The cutting unit 23 is composed of a movable cutter 24*a* fixed to a tip end of a piston rod 25*a* of the pneumatic cylinder 25. Cylinder 25 is secured to the body of the automatic sewing machine 1 in known manner, typically via a supporter (not shown). A stationary cutter 24*b* is secured to the automatic sewing machine in known manner, typically via a supporter (not shown). The pneumatic cylinder unit 25 is actuated to move the movable cutter 24*a* toward and away from the fixed cutter 24*b* whereby the towel material A positioned between the movable cutter 24*a* and the fixed cutter 24*b* is cut off.

The towel cloth drawing unit 3 includes a body 4 of an L-shaped bar extending across the width of the towel cloth A. A plurality of pneumatic cylinder 5 each having pistons penetrating the body 4 are arranged in a predetermined interval. A plurality of correction pieces 6 are each fixed to an end of the pistonrod without interfering with each other for contacting and pressing the surface of the towel cloth. A bracket 7 is fixed to an end of the body 4 and has a belt clip 7*a* fixed to the bracket 7. Clip 7*a* engages timing belt 9, which is driven by a drive motor 8 disposed at a side of the automatic sewing machine 1. A guide rail 10 is placed in parallel with the timing belt 9 to guide the bracket 7. The body 4 is moved upward by the drive motor 8, permitting a clamping unit 6 (described later) to pass between the body 4 and the towel cloth A. The body 4 is vertically moved up and down by forward and reverse operation of drive motor 8. Each piston rod is actuated by the pneumatic cylinders 5 so that each correction piece 6 presses the upper surface of the towel cloth A and draws the towel cloth affected individually by the correction piece 6, whereby the misalignment of the towel cloth is corrected.

The clamping unit 26 includes a base plate 27 slidable on the second table 2*a* in the longitudinal direction of the towel cloth A toward the second table 2*b*. A fixed metal piece 28*a* projects from an end of the base plate 27. A movable metal piece 28*b* is disposed opposite the fixed metal piece 28*a* and is swingably pivotally supported by a bracket on the base plate 27. A pneumatic cylinder 29 has a piston rod 29*a* for actuating the movable metal piece 28*b*. Pneumatic cylinder 29 is pivotally mounted on a bracket on the base plate 27 at the end thereof. The tip end of the piston rod is pivotally mounted on an attached member 29*b* secured to the movable metal piece 28*b*. The pneumatic cylinder unit 29 is actuated forwardly, namely, to permit the movable metal piece 28*b* to move toward the fixed metal piece 28*a* so that the towel cloth A positioned between the movable metal piece 28*b* and the fixed metal piece 28*a* is held by the movable metal piece 28*b* and the fixed metal piece 28*a*. The pneumatic cylinder unit 29 is actuated rearwardly, namely to permit the movable metal piece 28*b* to move away from the fixed metal piece 28*a* so that the movable metal piece 28*b* and the fixed metal piece 28*a* releases the clamping of the towel cloth A.

A actuation means 30 in the form of a pneumatic cylinder has a movable part secured to the lower surface of the base plate 27 and a stationary part secured to the body of the automatic sewing machine 1 for moving the clamping unit 26. The actuation means 30 may also take the form of a rack fixed to the base plate 27 and a pinion fixed to the body of the automatic sewing machine 1.

An operation of the device for drawing towel cloth according to the present invention will be described with reference to FIG. 4(*a*) through 4(*f*).

The clamping unit 26 is inserted into an opening defined between the movable cutter 24*a* and the fixed cutter 24*b* by the forward movement of the actuation means 30 as shown in FIG. 4(*a*). The movable metal piece 28*b* and the fixed metal piece 28*a* clamp the end portion of the plain fabric portion 2A of the towel cloth A. At first the towel cloth drawing unit 3 is placed in an upward position by the normal actuation of the drive motor 8. The movable cutter 24*a* of the cutting unit 23 is placed in an upward position by the reverse actuation of the pneumatic cylinder 25. The upper block of the thickness detector 20 is placed in an upward position 21*a* by the reverse actuation of the pneumatic cylinder 22 so that the thick pile fabric portion 1A of the towel cloth A passes through the opening.

Thereafter, as shown in FIG. 4(*b*), the towel cloth A is drawn to a predetermined position by moving the clamping unit 26 backward by the backward actuation of the actuation means 30.

Thereafter, as shown in FIG. 4(*c*), the towel cloth drawing unit 3 is lowered by a reverse actuation of the drive motor 8 to lower the pile fabric portion 1A of the towel cloth A in the direction of the space 2*c* between the first and the second working tables 2*a*, 2*b* while pressing the pile fabric portion 1A. The rear portion of the succeeding plain fabric portion 2A is positioned in the slit T defined between the upper and the lower blocks 21*a* and 21*b*.

Thereafter, as shown in FIG. 4(*d*), the upper block 21*a* is lowered by the forward actuation of the pneumatic cylinder 22 to form the stoppage gap T in the slit T defined between the upper and the lower blocks 21*a*, 21*b* for permitting the thin plain fabric portion 2A to pass therethrough but preventing the thick pile fabric portion 1A from passing therethrough. Each correction piece 6 is lowered by the forward actuation of each pneumatic cylinder 5 for pressing the pile fabric portion 1A and individually drawing the towel cloth A affected by the correction piece 6. The tip portion of the succeeding pile fabric portion 1A is arranged between the slit T of the thickness detector 20.

Thereafter, as shown in FIG. 4(*e*), the movable cutter 24*a* is lowered by the forward actuation of the pneumatic cylinder 25 of the cutting unit 23 for cutting the middle portion of the plain fabric portion 2A. The towel cloth drawing unit 3 is raised by the normal actuation of the drive motor 8 while each correction piece 6 is returned to the original position by the reverse actuation of the pneumatic cylinder 5. The upper block 21*a* is raised by the reverse actuation of the pneumatic cylinder 22 to expand the slit T so that the pile fabric portion 1A can pass the slit T.

Thereafter, as shown in FIG. 4(*f*), the clamping unit 26 releases the clamping of the towel cloth A and a piece of the cut towel cloth A is delivered to the next step. With repetition of the sequentially successive steps, the towel material is cut off preparing many towel cloths A.

As evident from the explanation set forth above, firstly, the towel cloth A is drawn by the lowering operation of the towel cloth drawing unit 3 until the rear portion of the succeeding plain fabric portion 2A reaches the front portion of the slit T of the thickness detector 20; secondly, the towel cloth A affected by each correction piece 6 is individually drawn; thirdly, the tip portion of the succeeding pile fabric portion 1A is arranged in the slit T of the thickness detector 20, whereby the misalignment of the towel cloth is corrected by the simple structure. Furthermore, the small sized towel cloth is cut off without any obstacle.

In summary, in a first step, the body 4 is moved upward and the clamping unit 26 mounted on the second working table **2*b* is moved toward the first working table 2*a* and the end portion of the plain fabric portion 2A of the towel cloth A is clamped by the fixed piece 28*a* and the movable metal piece 28*b* of the clamping unit 26, then the clamping unit 26 starts to return to the original position. In a second step, the body 4 is lowered in the space 2*c* to draw the towel cloth A until the rear end of the succeeding plain fabric portion 2A reaches the front of the thickness detector 23. In a third step, the correction pieces 6 are urged downward to press the upper surface of the towel cloth A and draw the towel cloth A individually affected by the correction pieces 6 for thereby permitting the tip portion of the pile fabric portion 1A** to arrange at the front of the slit T whereby the misalignment of the cloth A is corrected.

Although the invention has been described in its preferred form with a certain degree of particularity, it is to be understood that many variations and changes are possible in the invention without departing from the scope thereof.

What is claimed is:

1. A device for correcting misalignment of towel cloth adapted for use with an automatic sewing machine and comprising:

a pair of first and second working tables integrated with said sewing machine and respectively disposed oppositely and defining a space therebetween;

a detector located at an end of the first working table for distinguishing a plain fabric portion from a pile fabric portion of a towel cloth delivered to the first working table, said towel cloth having a plain fabric portion and a pile fabric portion which is continuous one after the other;

a cutting unit disposed across the first working table and spaced from the detector in a predetermined interval, said cutting unit including means for cutting the towel cloth;

a towel cloth drawing unit composed of a bar member disposed over the space between the first and the second working tables and extending across the width of the upper surface of the towel cloth and means for moving the bar vertically for drawing the towel cloth from a towel material; and a clamping unit mounted on a base plate which is provided on the second working table, said clamping unit including means movable toward the second working table for clamping and drawing the towel cloth.

2. A device for correcting misalignment of towel cloth according to claim 1, wherein the detector is composed of an upper block and a lower block respectively disposed across the first working table and a pneumatic cylinder for positioning the upper and the lower blocks, said upper block being fixed to a tip end of a piston rod of the pneumatic cylinder which is fixed to the automatic sewing machine via a supporter while the lower block is fixed to the automatic sewing machine via a supporter for defining a slit therebetween for permitting the plain fabric portion to pass therefrom but preventing the pile portion from passing therefrom.

3. A device for correcting misalignment of towel cloth according to claim 1, wherein the cutting unit means is composed of a pneumatic cylinder fixed to the body of the automatic sewing machine, a movable cutter fixed to a tip end of a piston rod of the pneumatic cylinder via a supporter and a fixed cutter which is fixed to the body of the automatic sewing machine via a supporter, said pneumatic cylinder unit being actuated to move reciprocally for thereby moving the movable cutter toward the fixed cutter whereby the towel cloth positioned between the movable cutter and the fixed cutter is cut off.

4. A device for correcting misalignment of towel cloth according to claim 1 wherein the means for moving the bar includes a plurality of pneumatic cylinders, each cylinder having a piston rod penetrating the bar, and further includes a plurality of correction pieces, each correction piece being fixed to the end of each corresponding piston rod and arranged in a predetermined interval without interfering with each other for contacting and clamping the surface of the towel cloth.

5. A device for correcting misalignment of towel cloth according to claim 1, wherein the towel cloth drawing unit further includes a bracket fixed to an end of the body and having a belt clip fixed to the bracket engaged with a timing belt which is driven by a drive motor provided at the body of the automatic sewing machine, and a guide rail disposed in parallel with the timing belt for guiding the bracket.

6. A device for correcting misalignment of towel cloth according to claim 1, wherein the clamping unit means is composed of a base plate slidable on the second table in the longitudinal direction of the towel cloth toward the first table, a fixed metal piece projected from an end of the base plate, a movable metal piece disposed opposite the fixed metal piece and swingably pivotally supported by a bracket on the base plate, and a pneumatic cylinder having a piston rod for actuating the moveable metal piece so that the moveable metal piece moves toward or away from the fixed metal piece to hold or release the towel cloth, said pneumatic cylinder being swingably mounted on a bracket on the base plate at the end thereof while the tip end of the piston rod is pivotally mounted on an attached member fixed to the movable metal piece.

7. A device for correcting misalignment of towel cloth according to claim 1, further including an actuation means for moving the clamping unit composed of a movable part fixed to the lower surface of the base plate and a fixed part fixed to the body of the automatic sewing machine.

8. A device for correcting misalignment of towel cloth according to claim 6, wherein the actuation means is composed of a rack fixed to the base plate and a pinion fixed to the body of the automatic sewing machine.

* * * * *